United States Patent [19]

Martinez

[11] 4,055,341

[45] Oct. 25, 1977

[54] TILTING MAZE RACE GAME

[75] Inventor: Daniel G. Martinez, Sylmar, Calif.

[73] Assignee: Gilbert Sacks Enterprises, Inc., El Monte, Calif.

[21] Appl. No.: 714,056

[22] Filed: Aug. 13, 1976

[51] Int. Cl.[2] ..... A63B 71/04; A63F 9/14

[52] U.S. Cl. ..... 273/86 C; 273/110

[58] Field of Search ..... 273/153 R, 110, 109, 273/86 C

[56] References Cited

U.S. PATENT DOCUMENTS

| | | | |
|---|---|---|---|
| 2,008,588 | 7/1935 | Moodie | 273/110 |
| 3,188,087 | 6/1965 | Larson | 273/115 |
| 3,674,271 | 7/1972 | DeGelder et al. | 273/128 R |
| 3,811,676 | 5/1974 | Greenberg | 273/110 |
| 3,879,039 | 4/1975 | Holden | 273/110 |

FOREIGN PATENT DOCUMENTS

| | | | |
|---|---|---|---|
| 27,147 | 1/1955 | Finland | 273/110 |
| 767,766 | 2/1934 | France | 273/110 |
| 365,064 | 12/1922 | Germany | 273/110 |

*Primary Examiner*—Richard C. Pinkham
*Assistant Examiner*—Lawrence Everett Anderson
*Attorney, Agent, or Firm*—Nilsson, Robbins, Dalgarn, Berliner, Carson & Wurst

[57] ABSTRACT

A game apparatus having a pair of tiltable platforms mounted upon a base with a stationary goal section positioned between the two platforms. A tortuous path or maze is provided in the surface of each of the platforms along which a ball may roll. Players stand upon the platform and manipulate the same by shifting their weight to cause the ball to traverse the maze and at the conclusion of the maze to enter the goal section, If desired, four platforms may be provided disposed at 90° displaced positions around the goal sections thereby allowing up to four players to simultaneously play the game.

11 Claims, 8 Drawing Figures

TILTING MAZE RACE GAME

BACKGROUND OF THE INVENTION

There are in existence a number of games which require skill and coordination of body movement to play them. Some prior art games include the manipulation of a ball or similar article into predesignated areas. There are, however, no prior art games known to applicant which can be participated in by two to four persons simultaneously through the coordinated movement of the body by shifting of the weight from foot to foot in synchronization with the movement of the object ball to cause the ball to move through a tortuous path and into a predesignated goal area. Those prior art game apparatus known to applicant are illustrated in U.S. Pat. Nos. 3,188,087, 3,618,949; 3,799,546 and 3,879,039.

SUMMARY OF THE INVENTION

A game apparatus for utilization by at least two players simultaneously which includes a base member having first and second platforms pivotally engaging the base member with a ball receiving member fixedly mounted upon the base between the platforms. Each of the platforms defines a tortuous path through which a ball may travel, the exit point of which aligns with an opening in the ball receiving member.

DESCRIPTION OF THE INVENTION

When people gather at the beach, around the pool, in the back yard or in the home it is often very desirable to provide entertainment by way of a game in which the individuals concerned may directly participate. Such games become even more enjoyable when two or more people can participate in the game simultaneously (one on one competition) and where there is some skill involved on the part of the player. The game apparatus constructed in accordance with the present invention satisfies these needs. The present invention is a game of skill in that through transference of the weight of the body from one foot to another, or by utilization of the hands of the player and transference of force from one hand to another, a maze is manipulated in such a manner as to cause a ball deposited therein to move through the maze in a predetermined manner and to be deposited into a goal at the opposite end of the maze. The individual who first causes the ball to traverse the maze and come to rest at the goal wins as between the two players. Obviously the game may be played in such a way as to eliminate players chosen in pairs and to have the winners of each such elimination then also compete against each other and so on until a winner out of the group is selected. In those instances where the apparatus is designed for play by four players simultaneously, one may select teams of players who then compete in the same manner. If desired, a timing apparatus can be incorporated against which the players must also compete.

Figure 1:
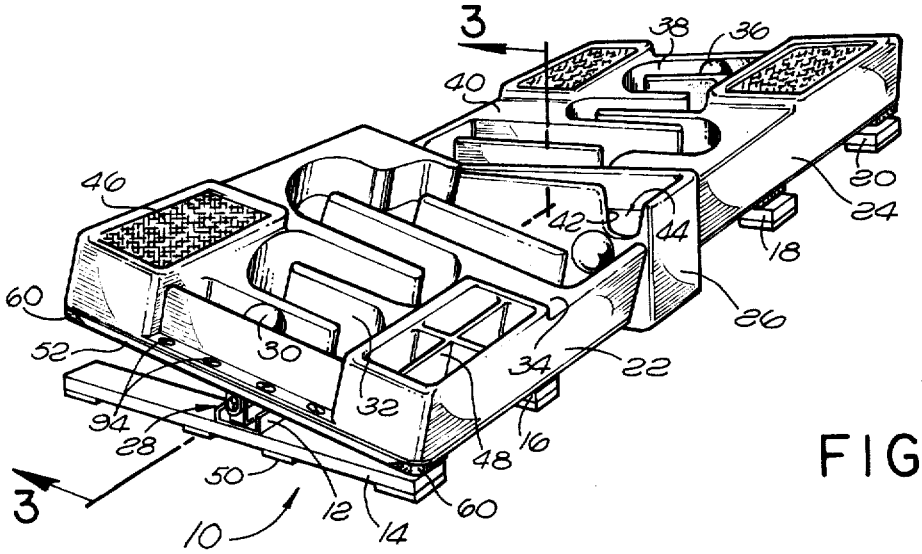
FIG. 1 is a perspective view of a game apparatus constructed in accordance with the present invention and which is designed for use with two players simultaneously.

As is illustrated in FIG. 1 an apparatus constructed in accordance with the present invention includes a base member 10 which is constructed of a longitudinally disposed beam 12 and a plurality of cross beams 14, 16, 18 and 20. First and second platforms 22 and 24, respectively, pivotally engage the base 10 so as to permit the platforms 22 and 24 to pivot or rock relative to the base 10. A ball receiving or goal member 26 is fixedly attached to the base member 10 and is disposed between the two platforms 22 and 24.

One form of pivotal engagement of the platforms 22 and 24 to the base 10 may be a clevis-type arrangement affixed to the platform and a similar clevis affixed to the base 10 with a pivot pin disposed between the two clevises. This arrangement will permit the platforms to be pivoted about a longitudinal axis extending along the base. Thus as the two platforms 22 and 24 are pivoted upon the base 10 a ball 30 or similar article may be caused to traverse a tortuous path or maze 32 disposed in the upper surface 34 of the platform 22 while similar manipulation of the platform 24 would cause a ball or similar article 36 to traverse a similar torturous path or maze 38 appearing in the upper surface 40 of the platform 24.

The ball receiving apparatus or goal 26 may be securely affixed to the base 10 as by bolting the same to the longitudinal beam 12 as will be more fully described hereinafter. The goal 26 has an opening 42 provided at one end thereof which aligns with the maze 32 on the platform 22 so that the ball 30 may enter the opening 42 but only when the platform 22 is in a predetermined tilted position. As will be recognized by those skilled in the art, the player must cause the ball to roll from left to right as viewed in FIG. 1 and at the precise moment with the speed of the ball moving from left to right the player must shift his weight to the left causing the platform 22 to tilt upwardly on the righthand side thereof causing the end of the maze to align with the opening 42 at the precise moment the ball reaches the opening 42 to thereby cause it to propel into the channel 44 in the ball receiving member 26 and to thus roll downwardly toward the center thereof and into the goal position. At the opposite or left side of the ball receiving member 26, as viewed in FIG. 1, a similar structure is provided (not shown in FIG. 1) which aligns with the maze 38 on the platform 24.

Each of the platforms is provided with a textured traction surface, for example as shown at 46 on the platform 22, which may be used to receive the force of the players weight during the manipulative process. Obviously the player may stand upon the textured surface 46 or may use his hands thereagainst as desired. To withstand the weight of a relatively heavy player upon the surface 46, the same may be reinforced by an internal rib structure as illustrated at 48 on platform 22. Similar such structure would, of course, be duplicated in platform 24.

Friction pads 50 may be provided on the cross braces 14 through 20 to provide better traction and thus to prevent skidding should the base 10 be positioned upon a rather slick supporting surface. Also provided at each end of the platform supporting braces 52, 54, 56 and 58 are shock absorbing bumpers 60. The bumpers 60 function to soften the noise generated by the players when pivoting the platforms 22 and 24 and at the same time to prolong the life of those parts of the structure which come into contact with each other.

Although the platforms 22 and 24 may be constructed of any material which is desired, it is preferable to mold the same of plastic materials such as cross-linked polyethylene, polystyrene, or various vinyls. The base member and support beams may be constructed of any material desired such as wood, aluminum, steel tubing and the like.

Figure 2:
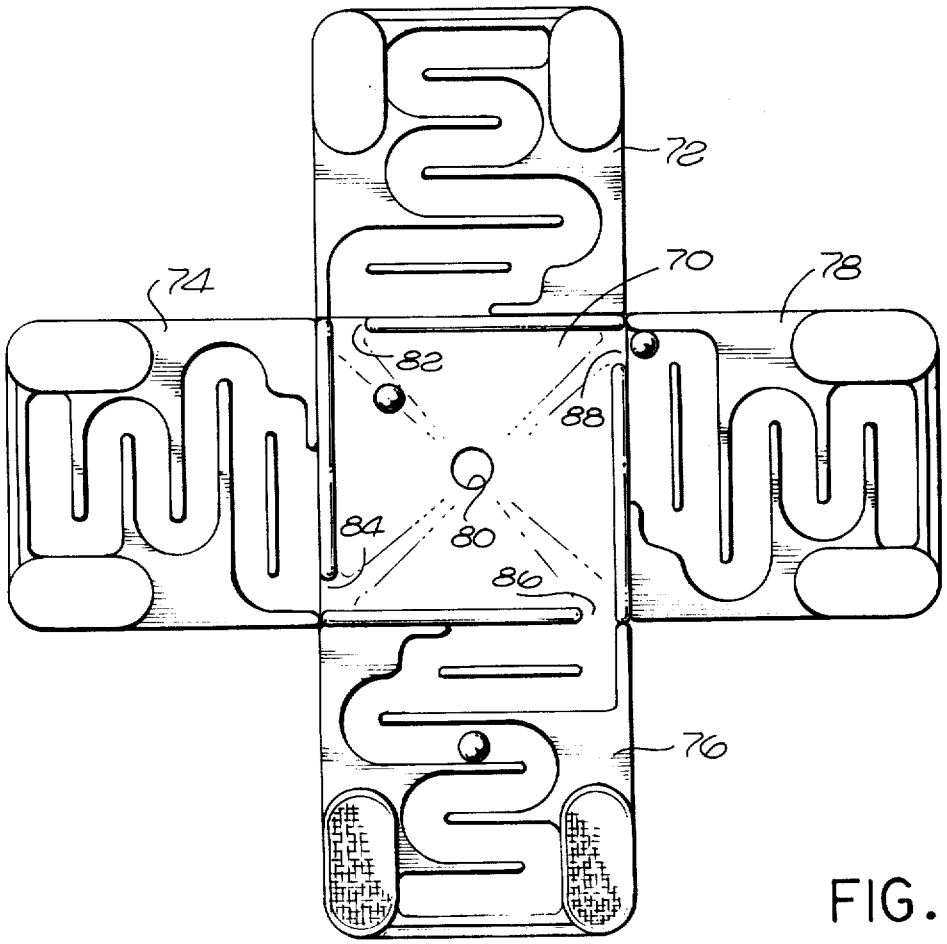
FIG. 2 is a top plan view of an apparatus constructed in accordance with the present invention and designed for utilization by up to four players simultaneously.

An alternative embodiment of a game apparatus constructed in accordance with the present invention is illustrated in FIG. 2 to which reference is hereby made. As is therein shown a ball receiving member 70 has four platforms 72, 74, 76 and 78 disposed at 90° angles thereabout. Each of the platforms 72 through 78 is pivotally secured to a base in the manner above described while the ball receiving member 70 remains stationary. A maze is provided in each of the platforms 72 through 78 and a ball is caused to travel therethrough as above indicated. The ball receiving apparatus defines a goal portion in the center thereof as is illustrated at 80 and contains four openings 82, 84, 86 and 88 which align with the maze on platforms 72 through 78, respectively, and function in the manner as above described. Thus it can be seen that to utilize the apparatus as disclosed in FIG. 1 and above described for use with four players one need only increase the size of the goal and add the two additional platforms at the opposed surfaces thereof. In all other respects the structure and operation of the game is as described above in conjunction with FIG. 1.

Figure 3:
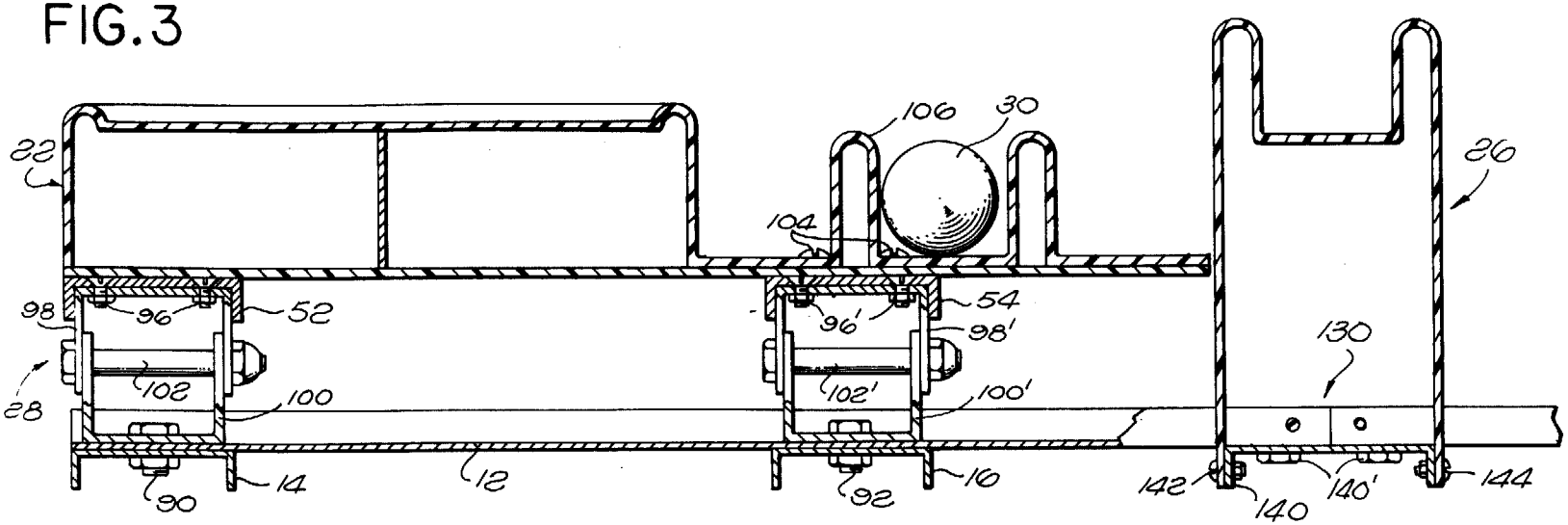
FIG. 3 is a partial cross sectional view taken about the lines 3—3 of FIG. 1.

By reference now to FIG. 3 further details of the construction of the apparatus as disclosed in FIG. 1 are shown. As is therein illustrated the cross beams 14 and 16 are in the form of U-shaped channels which are secured by way of bolts 90–92, to respectively the longitudinal beam 12. The platform supporting beams 52 and 54 are secured by a plurality of screws 94 (FIG. 1) to the platform 22 and in turn by the screws 96 to the clevis 98 of the pivot member 28. The other clevis 100 of the pivot member 28 is secured to the longitudinal beam 12 and the cross beam 14 by means of the bolt 90. A pivot pin 102 secures the two clevises 93 and 100 together in a pivotal fashion so that the platform 22 may pivot or rock with respect to the base 10 about the axis of the pivot pin 102. A similar pivoting arrangement is also provided at the opposite end of the platform 22 as is shown by the same numbers primed.

As is also illustrated in FIG. 3 additional screws 104 may also be used to attach the platform 22 to the support beam 54. It should be specifically noted that the screws 104 are placed immediately adjacent the raised members 106 defining the sides of the maze through which the ball 30 travels. By placing the screws 104 in such a position it should be noted that adequate clearance is provided so that the ball 30 does not contact the heads of the screws 104 during its travel through the maze.

It will be recognized by those skilled in the art that the particular maze 32 or 38 may be changed if such is desired by the players through the simple expedient of providing the members which define the maze track in such a manner that they may be snapped into or out of position by the players. Such may be done by removal of individual portions or in fact the entire molded plastic upper portion or shell and the replacement thereof with an alternative maze pattern shell.

Figure 4B:
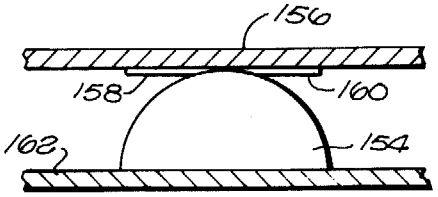
FIG. 4 is a view of the pivotal mounting apparatus used to mount the platforms of the apparatus constructed in accordance with the present invention.
Figure 4A:
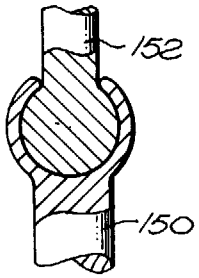
Figure 4C:
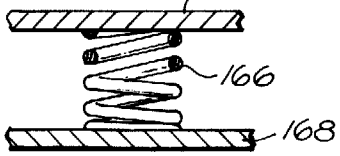
Figure 4:
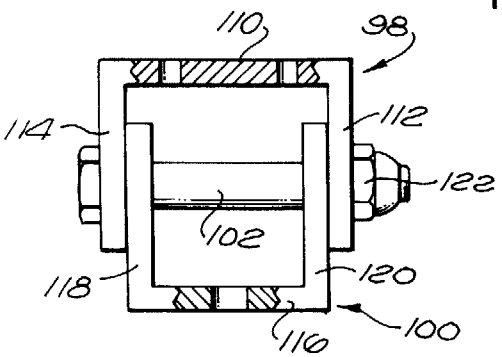

It will, of course, be recognized by those skilled in the art that numerous types of attachments other than the clevises shown in FIG. 3 may be utilized between the platform and the base, each of which will provide the desired pivotal attachment to permit the platforms to be rocked or pivoted with respect to the ball receiving goal means in each case. Several such alternative attaching means is illustrated in FIGS. **4*a* through 4*c* to which reference is hereby made. As is illustrated in FIG. 4*a* there is provided a ball and socket-type joint which may be attached at one end thereof to the platform and at the other end thereof to the base. As will be readily recognized the socket member 150 may be attached to the base member while the ball portion 152 may be attached to the platform. The means of attaching would be well recognized by those skilled in the art and thus is not illustrated. The players may then mount the platform and cause the ball section 152 to move within the socket section 150** to provide the desired rocking or tilting motion as above described.

FIG. **4*b* shows a rocker mechanism which includes a solid member 154 having straps preferably constructed of spring steel or the like attached to one side of the hub member 154 and extending upwardly over the top thereof and attached to the bottom portion of the platform supporting member 156. Such is as illustrated at 158 and 160. The bottom portion of the hub 154 is attached to the base member 162.**

An additional means of supporting the platform on the base is illustrated in FIG. **4*c* which shows the utilization of a resilient member such as a spring 166 which is secured between the base member 168 and the platform supporting member 170. To provide better stability in the event springs, such as shown at 166,** are utilized they may be disposed at each of the four corners of the platform member as opposed to being disposed longitudinally along the center thereof. This will, of course, depend upon the stiffness of the springs utilized as well as the size thereof.

Figure 5:
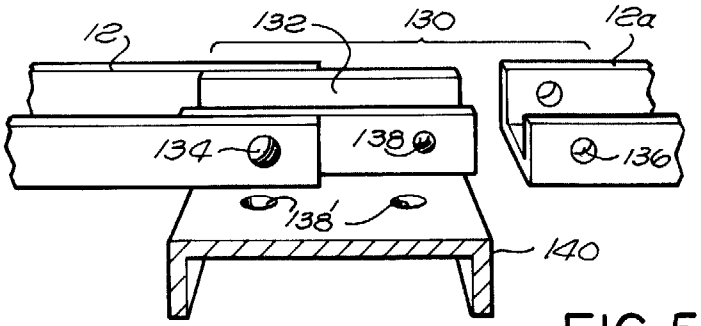
FIG. 5 is a partially exploded view of a portion of the apparatus as illustrated in FIGS. 1 and 3 which further illustrates means for assembly and disassembly of the apparatus constructed in accordance with the present invention.

At times it is desirable to break the apparatus as above described into smaller sections for purposes of shipping the same or storing the same when it is not in use. By reference to FIG. 5 there is disclosed a preferred construction which enables one to break the unit constructed in accordance with the present invention into three separate sections. The center coupling 130 (FIG. 3) includes a separate coupling channel 132 which is disposed internally of the longitudinal channel members 12 and **12*a*. A screw may be inserted as illustrated at 134 into openings such as shown at 136 and 138 in the channels 12*a* and 132, respectively, to thereby hold and align the coupling channel 132 in the longitudinal channels 12–12*a*. After such proper alignment and positioning the longitudinal channel 12–12*a* is then positioned in place over the openings shown at 138' in the cross members 140 upon which the ball receiving member is disposed. Thereafter four coupling bolts, two of which are shown at 140' (FIG. 3), are inserted in place to secure the longitudinal beams 12–12*a* in place on the structure. As will be noted by reference to FIG. 3 the ball receiving section is secured by the bolts 142, 144 permanently to the member 140. Obviously by removal of the bolts 140' and the screws 134 the two platforms may be immediately removed from the coupling channel 132** and thus the entire structure easily is broken down into three separate very manageable portions which can be quickly and easily reassembled as desired.

What is claimed is:

1. A game apparatus for use by at least two players simultaneously comprising:

a. a base member;

b. first and second platforms pivotally engaging said base member in spaced apart relationship thereon, each of said platforms defining a tortuous path through which a ball may travel; and c. a ball receiving member fixedly mounted upon said base between said platforms and defining first and second openings therein, said first opening aligning with the tortuous path in said first platform and the second opening aligning with the tortuous path in said second platform, the lowermost part of said first opening and the surface of said tortuous path in said first platform are aligned only when said first platform is in a predetermined tilted position and the lowermost part of said second opening and the surface of said tortuous path in said second platform are aligned only when said second platform is in a predetermined tilted position.

2. Game apparatus as defined in claim 1 wherein each of said platforms further includes a pair of spaced apart areas for receiving the feet of a player.

3. Game apparatus as defined in claim 1 which further includes means for attaching each of said platforms to said base member.

4. Game apparatus as defined in claim 3 wherein said means for attaching extends along a common axis disposed longitudinally of said base member.

5. Game apparatus as defined in claim 4 wherein said means for attaching further includes journal means affixing between said base member and said platforms for restricting pivotal movement of said platforms to about said longitudinal axis only.

6. Game apparatus as defined in claim 5 wherein said journal means includes first and second pairs of clevises and a pivot pin therefor attached between said base member and each of said platforms at opposite ends thereof.

7. Game apparatus as defined in claim 3 wherein said means for attaching is a pair of clevises one of which is attached to said base member and the other to said platform, and a pivot pin secured to said clevises.

8. Game apparatus as defined in claim 5 wherein said means for attaching is a ball and socket joint.

9. Game apparatus as defined in claim 3 wherein said means for attaching is a resiliently deformable member.

10. Game apparatus as defined in claim 9 wherein said resiliently deformable member is a spring.

11. Game apparatus as defined in claim 3 wherein further includes platform supporting bases and means detachable securing said platforms thereto whereby said tortuous path on said platforms is removable and replaceable by a different tortuous path.

* * * * *